United States Patent [19]

Freeman

[11] Patent Number: 4,610,491

[45] Date of Patent: Sep. 9, 1986

[54] HINGED BARRIER FOR A REFRIGERATOR SHELF

[76] Inventor: Lowell J. Freeman, 95094 Turnbow La., Junction City, Oreg. 97448

[21] Appl. No.: 631,486

[22] Filed: Jul. 16, 1984

[51] Int. Cl.[4] ..... A47B 77/04

[52] U.S. Cl. ..... 312/291; 312/313; 312/319; 312/328

[58] Field of Search ..... 49/131, 386; 108/60; 312/291, 313, 319, 328; 211/150, 184

[56] References Cited

U.S. PATENT DOCUMENTS

| | | | |
|---|---|---|---|
| 2,461,256 | 2/1949 | Black | 248/231.6 |
| 2,976,101 | 3/1961 | Rooney | 211/150 |
| 3,045,831 | 7/1962 | Pendergrast | 211/150 |
| 3,388,808 | 6/1968 | Radek | 211/150 |
| 3,625,371 | 12/1971 | Dill | 312/313 |
| 4,437,572 | 3/1984 | Hoffman | 211/184 |
| 4,500,147 | 2/1985 | Reister | 312/291 |

*Primary Examiner*—William E. Lyddane
*Assistant Examiner*—Joseph Falk
*Attorney, Agent, or Firm*—James D. Givnan, Jr.

[57] ABSTRACT

A barrier assembly with a spring biased barrier for attachment to a refrigerator shelf. Upper and lower mounting plates clamp to the shelf. A barrier hinge is provided by forwardly projecting hinge members having eyes formed to receive the barrier. A limit stop is provided by angulated grill work members of the barrier which contact a mounting plate to limit upward travel of the spring biased barrier.

1 Claim, 3 Drawing Figures

HINGED BARRIER FOR A REFRIGERATOR SHELF

BACKGROUND OF THE INVENTION

The present invention pertains generally to a shelf mounted barrier such as for use on refrigerators in motor homes, vacation trailers, campers, etc.,.

Food articles and containers stored on shelves are subject to shifting about the shelf during vehicle travel. Often shelf contents will migrate forwardly on the shelf to lodge against the refrigerator door resulting in the article falling to the floor upon opening of the door. Accordingly breakage and the spilling of food containers often occurs upon door opening at the end of a trip.

U.S. Pat. No. 2,976,101 discloses a refrigerator door shelf barrier capable of hinged movement but requiring modification of refrigerator door structure. Further, friction means are relied upon to permit the barrier to be positioned in both horizontal and vertical positions.

SUMMARY OF THE PRESENT INVENTION

The present invention is embodied in a barrier assembly attachable to virtually all refrigerator and cupboard shelves to confine articles thereon while permitting convenient access to same.

The present barrier assembly includes an upright member urged to an operative position whereat all shelf supported articles are confined against accidental loss particularly during door opening. A mounting arrangement is provided which permits convenient attachment of the assembly to most all refrigerator and other shelf designs without restriction of shelf storage area. A limit stop arrangement is provided to automatically relocate the barrier in a vertical position upon release.

Important objectives of the present barrier assembly include the provision of a barrier which confines food articles in place on a vehicle refrigerator shelf or a portion thereof or other shelf regardless of impacts, vibrations and attitude changes encountered by the vehicle during travel; the provision of a barrier assembly which permit convenient access to food articles on a shelf without a reduction in shelf area or hinderance to shelf use and without the risk of damage to an adjacent door; the provision of a barrier assembly lending itself to shelf attachment by the user.

BRIEF DESCRIPTION OF THE DRAWING

In the accompanying drawing

DETAILED DESCRIPTION OF THE INVENTION

Figure 1:
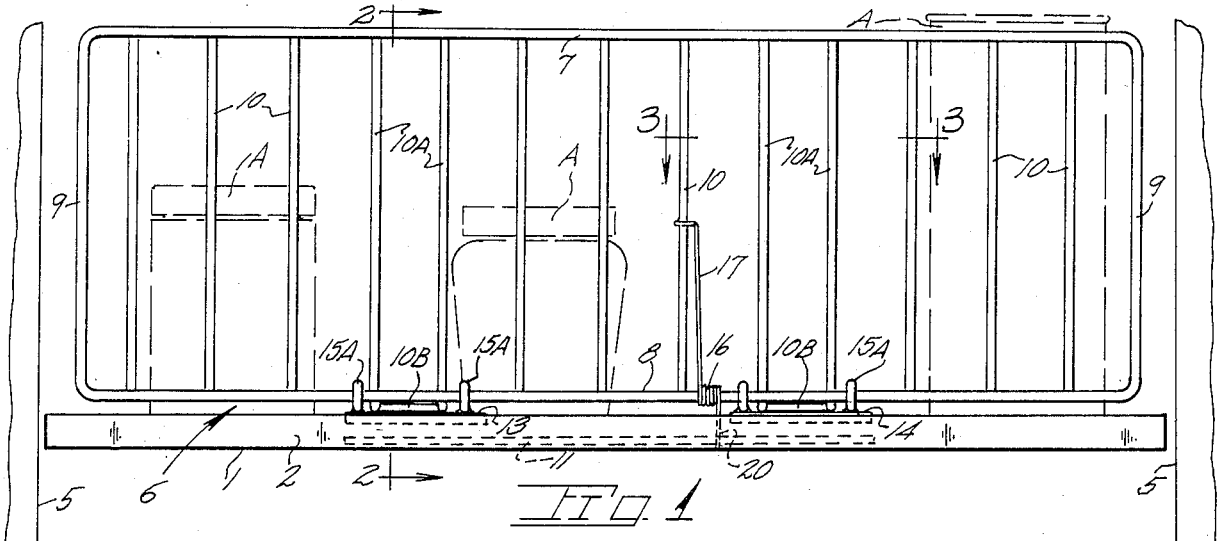
FIG. 1 is a front elevational view of the present barrier in place on a refrigerator shelf.
Figure 2:
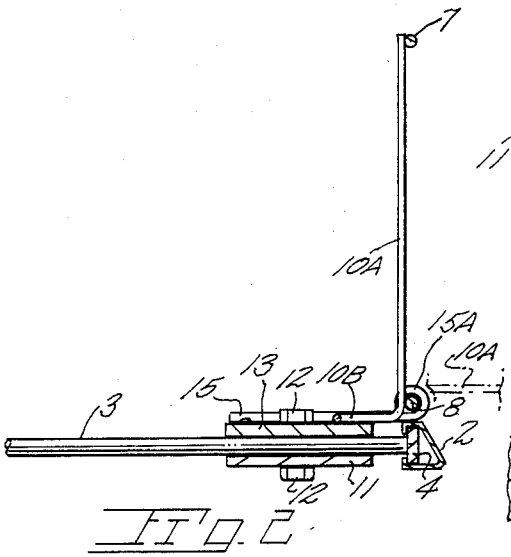
FIG. 2 is a vertical sectional view taken along line 2—2 of FIG. 1.

With continuing reference to the drawing wherein reference numerals indicate parts similarly hereinafter identified, the reference numeral 1 indicates a refrigerator shelf having a forward edge 2 usually embodied in a decorative strip. Typically such shelves are of welded wire construction having wire grillwork elements 3 and a cross member 4 joining their forward ends. The foregoing as depicted in the drawing are all located within the forward marginal area of a shelf of a vehicle installed refrigerator. The barrier is readily adaptible to other types of shelving. Wall structure is at 5.

A food article barrier is indicated generally at 6 and is preferably of wire construction for ease of manufacture and an unobstructed view of food articles as at A. Barrier 6 includes a frame having upper and lower longitudinal members 7 and 8 with end members at 9. A wire grillwork is at 10.

Mounting means of the barrier assembly includes a clamping arrangement for securement to the forward marginal area of the refrigerator shelf. A plate at 11 extends crosswise below several wire elements 3 of the refrigerator shelf and receives fastener assemblies 12 each of which serves to bias an upper mounting plate at 13 and 14 into clamped engagement with the refrigerator shelf. The upper mounting plates each carry hinge members at 15 shown embodied in wire segments rolled at 15A to form an eye within which is hingedly received lower member 8 of the barrier. The hinge members are secured in place to their respective mounting plates by welds at W.

Figure 3:
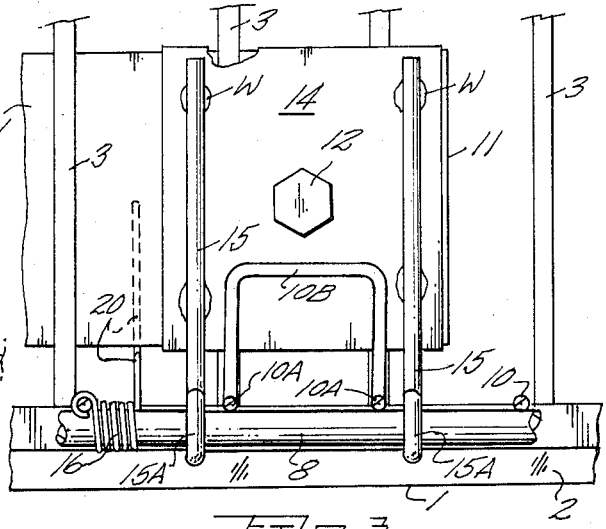
FIG. 3 is a horizontal sectional view taken along line 3—3 of FIG. 1.

For raising barrier 6 to an upright or operative position a spiral spring 16 has one leg 17 terminating in retained engagement with a barrier grill work component 10 while a remaining leg at 20 extends rearwardly from the spiral into underlying abutment with mounting plate 11. Spring biased movement of the barrier 6 is limited by limit stop means which may be, as shown in FIG. 3, provided by a barrier grill work component at 10A shaped with an angular extension 10B which contacts mounting plate 14 to limit arcuate travel of and position barrier 6 to the upright. Other limit stop arrangements; i.e., a limit stop component secured in place on the mounting plate and abutted by the barrier in a raised position.

While the foregoing described shelf barrier has been described in assocation with a refrigerator shelf it will be evident that the barrier may be equally applicable to other types of shelving to confine shelf supported articles until such are intentionally removed. Additionally, the preferred limit stop arrangement illustrated in the drawing lends itself to ease of manufacture and does not interfere, to any significant degree, with the passage of articles to or from the shelf.

While I have shown but one embodiment of the invention it will be apparent to those skilled in the art that the invention may be embodied still otherwise without departing from the spirit and scope of the invention.

Having thus described the invention, what is desired to be secured in Letters Patent is:

1. A barrier assembly for adjustible attachment to a shelf to confine articles on the shelf or a portion of the shelf, said assembly comprising, a barrier for normal disposition in an upright position and spaced above the shelf, said barrier including a frame having upper and lower members, upper and lower clamping plates for disposition above and below a portion of the shelf, fastening means for urging said clamping plates into shelf engagement, hinge members carried by the upper clamping plate and supporting said barrier in a hinged manner, a spring in place on the lower member of the barrier and biasing said barrier to an upright position, and limit stop means comprising angularly shaped wire grill components of the barrier and limiting hinged movement of said barrier in one direction to the upright position.

* * * * *